United States Patent [19]

Scott

[11] 3,958,790

[45] May 25, 1976

[54] CONCRETE WALL FORMING PANEL WITH INFLATABLE LINER MEANS

[76] Inventor: Samuel C. Scott, 2519 Walnut St., Denver, Colo. 80205

[22] Filed: May 6, 1974

[21] Appl. No.: 466,986

[52] U.S. Cl. ..... 249/65; 249/66 A; 249/189

[51] Int. Cl.[2] ..... E04G 9/05

[58] Field of Search ..... 249/65, 66 A, 112, 114, 249/189; 425/437, 440, DIG. 14, DIG. 19, DIG. 102; 264/314, 335

[56] References Cited

UNITED STATES PATENTS

| | | | |
|---|---|---|---|
| 1,146,413 | 7/1915 | Edison | 264/314 |
| 1,664,667 | 4/1928 | Davis | 425/437 |
| 1,983,757 | 12/1934 | Hick | 249/66 A |
| 2,047,624 | 7/1936 | Freedlander | 101/379 |
| 2,213,902 | 9/1940 | Daniels | 249/112 |
| 2,271,125 | 1/1942 | Juve | 101/379 |
| 2,480,477 | 8/1949 | Jones | 249/66 A |
| 2,575,734 | 11/1951 | Schulman | 425/DIG. 19 |
| 2,964,800 | 12/1960 | Dorsett | 249/16 |
| 3,317,178 | 5/1967 | Kreier, Jr. | 249/134 |
| 3,347,966 | 10/1967 | Seefluth | 249/66 A |
| 3,843,089 | 10/1974 | Scholz et al. | 249/158 |

*Primary Examiner*—Francis S. Husar
*Assistant Examiner*—John McQuade

[57] ABSTRACT

A form assembly for wall-like, large area concrete structures includes a generally planar, rigid panel arranged to abut similar adjacent panels providing a form for the wall-like sructure: a soft, resilient, stretchable plastic liner, mounted on and coextensive with the panel, with at least a complete peripheral seal between edge portions of the panel and the liner, with the liner being secured to the panel in the sealing areas so as to provide a generally airtight, inflatable pouch center-wise of the panel, and gas insertion means for inserting low pressure gas into the inflatable pouch portions for breaking the combined panel and liner from a set concrete structure.

9 Claims, 8 Drawing Figures

CONCRETE WALL FORMING PANEL WITH INFLATABLE LINER MEANS

Large, ordinarily vertical, concrete wall-like structures are generally formed by using a mold or form including braced, parallel spaced-apart walls consisting of panels, between which fluid concrete is poured and permitted to set. An adhesive bond is produced between the form members and the contained concrete which makes removal of the forms from the concrete difficult. As the size of the form panel members increases, usually in excess of conventional 4 × 8 foot panels up to about 4 × 12 foot panels and larger, the problem of the adhesion between the form panels and the concrete becomes more pronounced and makes substantial problems. The large panel forms have been stripped from the set concrete by means of cranes, being partially broken free by crowbars, and the like, which tends to damage the set concrete.

Recently, architectural surfaces have been produced on concrete walls, particularly commercial buildings, by means of soft resilient liners for the concrete forms, producing almost any desired surface configuration. These surfaces, simulating natural surfaces, such as rock, stone, wood, etc., and various types of uniform surfaces such as brick, fluted surfaces, broken fluted surfaces and the like, increase the surface area of the finished concrete, and, also, increase the adhesion between the forms and the set concrete. Due to the difficulty of the removal of the large panels of the concrete forms from the set concrete, it has been necessary to permit concrete to gain strength by setting for long periods, so that there is less danger of injury to the green concrete in the removal of the forms. This, of course, increases the length of time for the pour, and increases the cost of the construction. Additionally, as the size of the form panels has increased, larger pieces of equipment have become necessary for the form removal, as well as a greater number of workers are necessary in the removal of the forms from the set concrete.

According to the present invention, there is provided a large area form for generally planar concrete walls and the like, in which a soft, resilient, flexible liner of substantial thickness is adhered to the rigid concrete panel, with the liner being sealed to the rigid panel along complete peripheral areas, forming in effect a bladder generally centerwise of the panel. The bladder is air-tight, except for a gas inlet-outlet, and is expandable to permit the formation of a substantial bubble in the liner. Introduction of low pressure gas into the bladder expands the same, breaking substantially the whole panel from the set concrete over a large area. This provides pressure against the middle portions of the set concrete where the strength of the same is superior to the edge portions of the concrete. Thus, form panels may be quickly and easily broken away from the set concrete by the introduction of the low pressure gas forming a bubble of the bladder centerwise of the panel, without injury to the set concrete.

The soft, resilient liner of the panel may be the negative mold portion of a desired architectural surface for finished concrete, including such features as undercuts, deep impressions or the like in the concrete surfaces, substantial thickness differences in various portions of the surface of the concrete, and the like. The invention permits low pressure gas to be used to break the large form panels from generally planar surfaces of concrete by introducing the major form breaking force against the middle of the set concrete surfaces. This permits the removal of the forms from green concrete at a much earlier setting time than has heretofore been possible. This reduces the time necessary for holding green concrete in the forms, and reduces damage in removing the form panels from the concrete.

Included among the objects and advantages of the present invention is to provide a large concrete form assembly for generally planar surfaces, including walls, floors and the like, which includes built-in form removal means from the set concrete.

Another object of the invention is to provide a large concrete form for wall-like structures for making architectural surfaces and removal of the forms from the walls without damage to the surfaces.

Yet another object of the invention is to provide large panel concrete forms for generally planar surfaces with built-in easy-to-use pneumatic removal means of the individual panels from the set concrete.

An additional object of the invention is to provide means for easy removal of large panel forms from set concrete structures without injury to the green concrete contained in the forms.

These and other objects and advantages of the invention may be easily ascertained by referring to the following description and appended illustrations in which.

Figure 6:
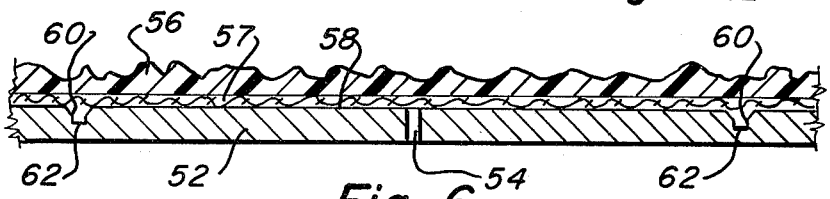
FIG. 6 is a cross-sectional view of a portion of a modified form panel, illustrating a sealing means between the rigid backing member and a flexible liner.
Figure 7:
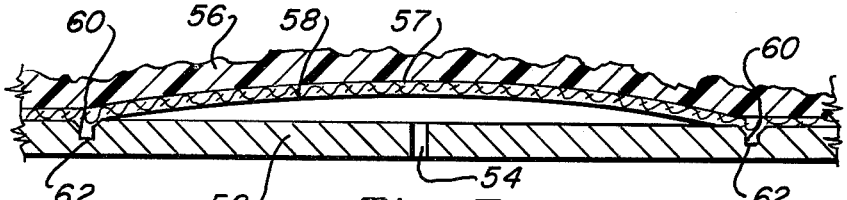
Figure 8:
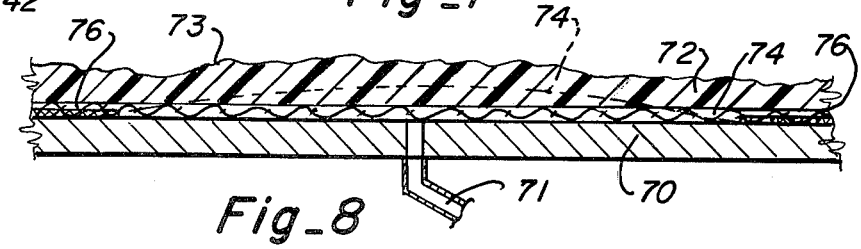

FIG. 7 is a cross-sectional view of the form panel and liner of FIG. 6, illustrating the pressurized bladder between the liner and the rigid backing member for breaking the form from the set concrete; and FIG. 8 is a cross-sectional detail of a slightly modified form of a rigid panel and a reinforced flexible liner secured thereto, for forming a bladder effect under low pressure gas for removal of the form panel from the set concrete.

Figure 1:
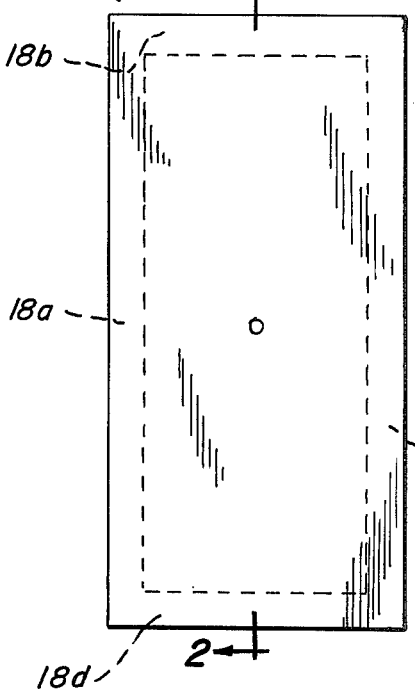
FIG. 1 is a plan view of a planar concrete panel, illustrating the adhesion areas of a thick resilient plastic panel liner to a rigid backing, and showing the peripheral seal between the liner and the panel.
Figure 2:
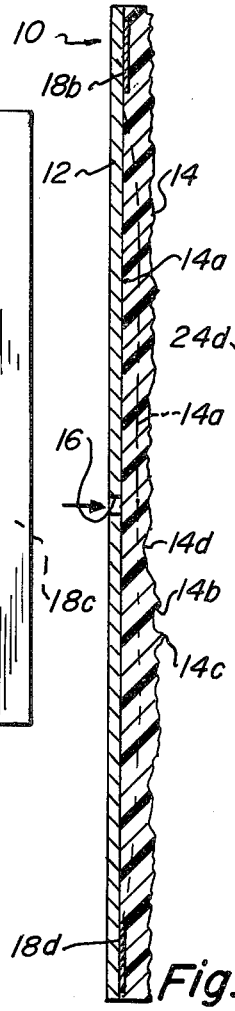
FIG. 2 is a cross-sectional view of the device of FIG. 1 taken along section lines 2—2.

In the device illustrated in FIGS. 1 and 2, a rigid rectangular concrete panel 12, which may be formed of plywood, steel, and/or combinations thereof, provides a rigid backing for a soft resilient flexible plastic liner 14. The liner is secured to the rigid panel 12 by means of a complete peripheral seal which includes portions 18a, 18b, 18c and 18d forming in effect an air tight pocket between the panel and the liner, generally centerwise of the panel 12. As illustrated in FIG. 2, the seal which may be formed by various types of adhesive, solvent, cement, sealant, or the like is illustrated thicker than would be normally found in the actual device, solely for illustration purposes. Thus, the seals 18b and 18d are illustrated as considerably thicker than would be the actual case for adhering the soft, flexible liner 14 to the rigid member 12. The soft, resilient, flexible liner 14 may be formed with a face having a surface for contacting concrete which is planar and smooth or may be formed as a negative mold for various architectural surface configurations. The rear face or panel contacting side 14*a* of the liner 14 is smooth and planar, providing a full face contact between the liner 14 and the surface of the panel 12. The concrete contacting face of the liner 14 may include such features, for example, as undercuts 14*b*, extensions or protrusions 14*c*, and/or depressions 14*d*. The undercuts such as 14*b* will produce an undercut on the finished concrete, and by providing the soft, resilient, flexible plastic liner, the liner will pull away from the green concrete without damage to the undercuts. Similarly, the protrusions such as 14*c* provide depressions in the finished concrete, and the flexible material is easily withdrawn from the depressions in the set concrete. Depressions in the liner produce projections on the finished concrete, and these are easily freed of the soft, resilient, flexible plastic without damage. An inlet 16 provides means for introducing low pressure gas into the unsealed space between the liner and the panel, so that the unsealed area of the planar, smooth surface 14*a* of the liner extends outwardly, forming a bubble or the like, as shown in FIG. 2 in the dash lines 14*a*.

The soft, flexible, resilient plastic liner when provided with a peripheral seal forms in effect a membrane or pocket which will produce a bubble in the liner when gas is introduced in the unsealed portions. By providing relatively large areas, a bubble formed in the pocket by very low pressure gas can pull or break the liner away from the green concrete. Where the area of the pocket, to form the prospective bubble, covers a substantial portion of the panel, pressure on the order of five pounds will be sufficient to break the panel, with the included liner, away from the green concrete by exerting the breaking pressure against the middle of the concrete and not along the edges. Thus the green concrete is safe from injury by the use of various conventionally used tools for removing panels from the concrete. A single workperson with a low pressure air compressor or a gas bottle, can easily break the largest panels from the concrete. A crane may be necessary to remove the panels from the area but not breaking them from the concrete.

Figure 3:
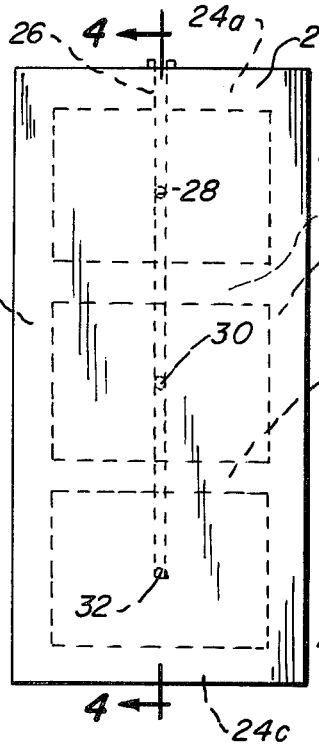
FIG. 3 is a front elevational view of a modified panel according to the invention, illustrating a plurality of pneumatic bladders in a form panel, and having a flexible liner secured to a rigid member.

The modified form of FIG. 3 provides a soft, flexible, resilient liner 20 peripherally sealed around the edges to a rigid backing panel 22. The peripheral seal includes top seal area 24*a*, side areas 24*b* and 24*d* and the bottom seal area 24*c*, providing a complete peripheral seal. Cross seal areas 24*e* and 24*f* form three pockets between the liner and the rigid panel. For pressurizing the pocket a line 26 includes laterals to openings 28, 30 and 32 in the pockets between the liner and the rigid panel. Thus by introducing low pressure gas into the manifold 26, all three of the pockets will be inflated and the form is easily broken from the set concrete. The pockets are pressurized by inlets 28, 30 and 32.

Figure 4:
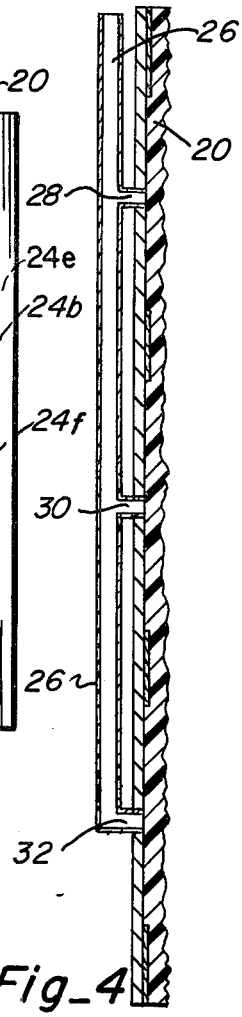
FIG. 4 is a cross-sectional view of the device of FIG. 3 taken along section line 4—4.
Figure 5:
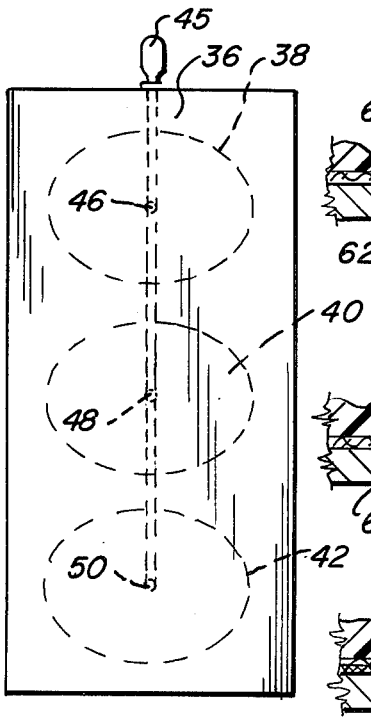
FIG. 5 is a front elevational view of a modified concrete form panel, illustrating modified plural bladders, and a simplified means of introducing gas into the bladders.

A slightly modified version of the device of FIGS. 3 and 4 is illustrated in FIG. 5, wherein the soft, flexible liner 36 is peripherally sealed to the rigid backing panel, not shown, in such a manner as to leave three oval pockets 38, 40 and 42. The pockets are respectively pressurized by means of openings 46, 47 and 48 which are in communication with a manifold 44. Low pressure gas is introduced into the pockets or envelopes 38, 40 and 42, as by means of a small sealed $CO_2$ bulb 45. By using $C0_2$ bulbs, such as the $C0_2$ bulbs used for life jackets, and the like, a single workman with minimum of equipment may very easily remove the various panels by simply inserting a $C0_2$ bulb into a receiver, breaking the seal thereof, and introducing the $C0_2$ into the pockets. This easily breaks the forms from the green concrete.

In some instances, it may be necessary to more securely seal the soft, resilient, flexible liner to the rigid backing, and by providing a groove in the rigid backing and providing a mating extension on the back of the soft, flexible lining, the lining may be securely held to the backing, as shown in FIGS. 6 and 7. In this case, the rigid backing 52, with a gas inlet 54, is provided with a peripheral groove 62, which may assume the shape of the pockets of FIG. 5, for example. The soft, resilient liner 56 is provided with an equivalent peripheral mating projection 60 for seating in the groove 62. The projection 60 is cemented into the groove, and the outer portions of the panel beyond the groove 62 may be, likewise, cemented together so that a small pocket is provided at the smooth back 58 of the panel 56 resting against the rigid panel 52. To further protect the soft, resilient liner, a two way stretch fabric 57 is molded into the liner, which permits the pocket to expand when low pressure gas is inserted into opening 54, as shown in FIG. 7. The groove and its adhered projections 60 prevents the soft, resilient liner from creeping and destroying the seal between that liner and the rigid backing. The two way stretch cloth 57, also, provides means for allowing the flexible, resilient material to bulge or bubble without damage thereto.

A modified version of a flexible, resilient liner with a cloth backing is illustrated in FIG. 8, wherein a liner formed of soft, resilient plastic 72 is sealed to a rigid backing panel 70 by means of a complete peripheral seal 76. The liner 72 is formed independently of the panel 72 and it is provided with a surface 73, which may be a negative mold of the desired configuration of the surface of the finished concrete. The liner is formed by pouring the plastic monomers into a mold, the bottom of which contains the desired configuration of the conrete surface, and thus the bottom surface of the plastic assumes the shape of the bottom of the mold producing the surface 73. Before the monomer sets into a polymer, a double stretch, nylon mesh cloth material (for example) may be pressed into the flat surface of the liner to provide reinforcement for the flexible liner. The cloth 74 along with the plastic material is sealed by means of seal 76 to the rigid backing 70. Thus when low pressure gas is introduced into a gas inlet 71, the soft resilient material forms a bubble, with the cloth material 74 providing protection from blowing out the bubble where the soft, resilient plastic is the thinnest.

The assembly of the soft, resilient liner peripherally sealed to the rigid backing permits the use of small, light weight air compressors, or pressurized gas bulbs to break the panel from the surface. The use of the grooves and liner projections of FIGS. 6 and 7 prevent delamination of the liner from the rigid panel, but permits forming the bubbles for breaking a form from the concrete. This, also, assists in the return of the liner to flat configuration on deflation. The bubbles may, also, be made by the use of a bladder placed between the liner and the rigid panel, and peripherally sealing the bladder between the two. This provides protection for blowing out the liner. However, the bladder must be flat and not extend the liner so as to leave an impression in the concrete. The same arrangement is usable for precast shapes, by using a soft, resilient, flexible liner in the molds for the precast shapes. By leaving pockets between the liner and the sides of the mold, the shape is easily removed from the molds. For large and long molds, it has been found that adhesion between the mold and the concrete shape makes removal very difficult. This is especially true where form lubricants or release agents cannot be used due to staining the concrete. Horizontal forms, also, provide a release problem which is easily solved by the system of the invention.

The inflatable pocket or bladder should cover a substantial area of the rigid panel member, so as to take advantage of low pressure gas for the breaking of the form from the concrete. Since the total pressure available for inflating the bladder is the area of the pocket times the gas pressure, it is preferable to use a large area bladder, available to press against the concrete. When plural pockets are used on the combined panel, they must be connected in such a way to equally pressurize them, to prevent all the gas going into one pocket causing a blow-out of the one pocket. Further, when plural pockets are used, the total area must be large (relative to the total area of the panel) to effectively utilize the low pressure gas.

I claim:

1. Apparatus for stripping large panel forms from set concrete wall-like structures comprising:

a large, rectangular, generally planar surfaced, substantially rigid concrete form panel member, said member being arranged for upright positioning so as to abut other panel members to provide a form structure spaced from similar panel members with a space for a concrete wall therebetween;

a soft, resilient, flexible form liner having a rear, planar surface mounted on and said rear surface being face to face and coextensive with the planar surfaced panel member;

sealing means securing said liner to said panel member at least along peripheral areas providing at least one unsealed portion generally center-wise of said panel member arranged as an inflatable pocket and said liner being in face engagement with said panel member when not inflated; and means through said panel for introducing low pressure fluid into said pocket for expanding the same and breaking the combined panel and liner from contained concrete.

2. Apparatus according to claim 1 wherein a plurality of pockets are formed between said panel member and said liner; and means are provided for introducing low pressure fluid into said pockets.

3. Apparatus according to claim 2 wherein said pockets are oval shaped.

4. Apparatus according to claim 2 wherein said pockets are rectangular.

5. Apparatus according to claim 1 wherein said liner is reinforced with cloth-like material.

6. Apparatus according to claim 1 wherein said means for introducing low pressure air is a low pressure air pump injecting air as the fluid for inflating said pocket.

7. Apparatus according to claim 1 wherein said means for introducing low pressure fluid includes passage means from said pocket to a point convenient for introduction of gas into said pocket.

8. Apparatus according to claim 7 wherein said passage means includes a $C0_2$ container and apparatus for introducing $C0_2$ from the container to said passage means.

9. Apparatus according to claim 1 wherein said liner includes a peripheral projection on its rear face around a pocket area, said panel includes a mating groove and said projection is sealed in said groove.

* * * * *